US009280982B1

(12) United States Patent
Kushner

(10) Patent No.: US 9,280,982 B1
(45) Date of Patent: Mar. 8, 2016

(54) NONSTATIONARY NOISE ESTIMATOR (NNSE)

(75) Inventor: William M. Kushner, Arlington Heights, IL (US)

(73) Assignee: GOOGLE TECHNOLOGY HOLDINGS LLC, Mountain View, CA (US)

( * ) Notice: Subject to any disclaimer, the term of this patent is extended or adjusted under 35 U.S.C. 154(b) by 1047 days.

(21) Appl. No.: 13/074,189

(22) Filed: Mar. 29, 2011

(51) Int. Cl.
*G10L 21/02* (2013.01)
*G10L 21/0232* (2013.01)
*G10L 21/0264* (2013.01)

(52) U.S. Cl.
CPC ..... *G10L 21/02* (2013.01); *G10L 21/0232* (2013.01); *G10L 21/0264* (2013.01)

(58) Field of Classification Search
CPC .. G10L 21/02; G10L 21/0232; G10L 21/0264
USPC ..... 704/210, 215, 226, 227, 228, 205; 381/94.3
See application file for complete search history.

(56) References Cited

U.S. PATENT DOCUMENTS 4,630,304 A * 12/1986 Borth et al. ..... 381/94.3
4,811,404 A 3/1989 Vilmur et al.
5,572,623 A * 11/1996 Pastor ..... G10L 25/87 704/233
5,822,726 A * 10/1998 Taylor et al. ..... 704/233
5,963,899 A * 10/1999 Bayya ..... G10L 21/0208 704/226
6,098,038 A * 8/2000 Hermansky et al. ..... 704/226
6,157,670 A 12/2000 Kosanovic
6,480,823 B1 * 11/2002 Zhao et al. ..... 704/226
6,804,640 B1 * 10/2004 Weintraub et al. ..... 704/226
7,283,956 B2 10/2007 Ashley et al.
7,428,490 B2 * 9/2008 Xu et al. ..... 704/226
7,590,530 B2 * 9/2009 Zhao et al. ..... 704/226
7,711,558 B2 * 5/2010 Jang et al. ..... 704/226
8,666,737 B2 * 3/2014 Nakajima ..... G10L 21/0208 704/226
2003/0097259 A1 * 5/2003 Balan et al. ..... 704/226
2005/0075870 A1 * 4/2005 Chamberlain ..... 704/226
2006/0270467 A1 * 11/2006 Song et al. ..... 455/570

(Continued)

OTHER PUBLICATIONS

Doblinger, Gerhard: "Computationally Efficient Speech Enhancement by Spectral Minima Tracking in Subbands", IEEE, Eurospeech—1995, pp. 1513-1516.

(Continued)

*Primary Examiner* — Martin Lerner
(74) *Attorney, Agent, or Firm* — Morris & Kamlay LLP

(57) ABSTRACT

A method for estimating acoustic noise in an environment where a mobile communication device is operating and where the acoustic noise includes nonstationary noise or speech-like noises, and wherein the environment also includes speech signals. The method includes searching for a local minimum energy over a plurality of frames using at least two reference signals including a first signal comprised of a time-sensitive current local minimum energy estimate, emin, and a second signal comprised of a time-weighted average of previous detected local energy minima, eminmean; and deciding whether the detected local energy minima of the second reference signal is a noise signal. Also, binning the detected input signal energy minima values within a plurality of histograms; and calculating a composite noise energy estimate comprised of a weighted sum of a maximum probability noise energy estimate and an expected value noise energy estimate. As such a nonstationary noise estimator is formed.

24 Claims, 13 Drawing Sheets

Block diagram depicting the major processes comprising the NNSE method.

(56) References Cited

U.S. PATENT DOCUMENTS

| | | | |
|---|---|---|---|
| 2008/0219472 | A1 | 9/2008 | Chhatwal et al. |
| 2009/0220107 | A1 | 9/2009 | Every et al. |

OTHER PUBLICATIONS

Martin, Rainer: "Noise Power Spectral Density Estimation Based on Optimal Smoothing and Minimum Statistics", IEEE Transactions on Speech and Audio Processing, vol. 9, No. 5, Jul. 2001, pp. 504-412.
Cohen, Israel: "Noise Spectrum Estimation in Adverse Environments: Improved Minima Controlled Recursive Averaging", IEEE Transactions on Speech and Audio Processing, vol. 11, No. 5, Sep. 2003, pp. 466-475.
U.S. Appl. No. 60/713675, filed Sep. 3, 2005, Zhao et al. "On Noise Gain Estimation for HMM-based Speech Enhancement".
ITU-T G.718, Telecommunication Standardization Sector of ITU, Series G: Transmission Systems and Media, Digital Systems and Netorks, Digital Terminal equipments-Coding of voice and audio signals (Jun. 2008), all pages.
Christophe Ris and Stephane Dupont: "Assessing Local Noise Level Estimation Methods: Application to Noise Robust ASR", Speech Communication, vol. 34, Issues 1-2, Apr. 2001, pp. 141-158.

* cited by examiner

Figure 1. Diagram of how a noise estimator such as the NNSE nonstationary noise estimator may be used in an acoustic signal processing device such as a radio communications device.
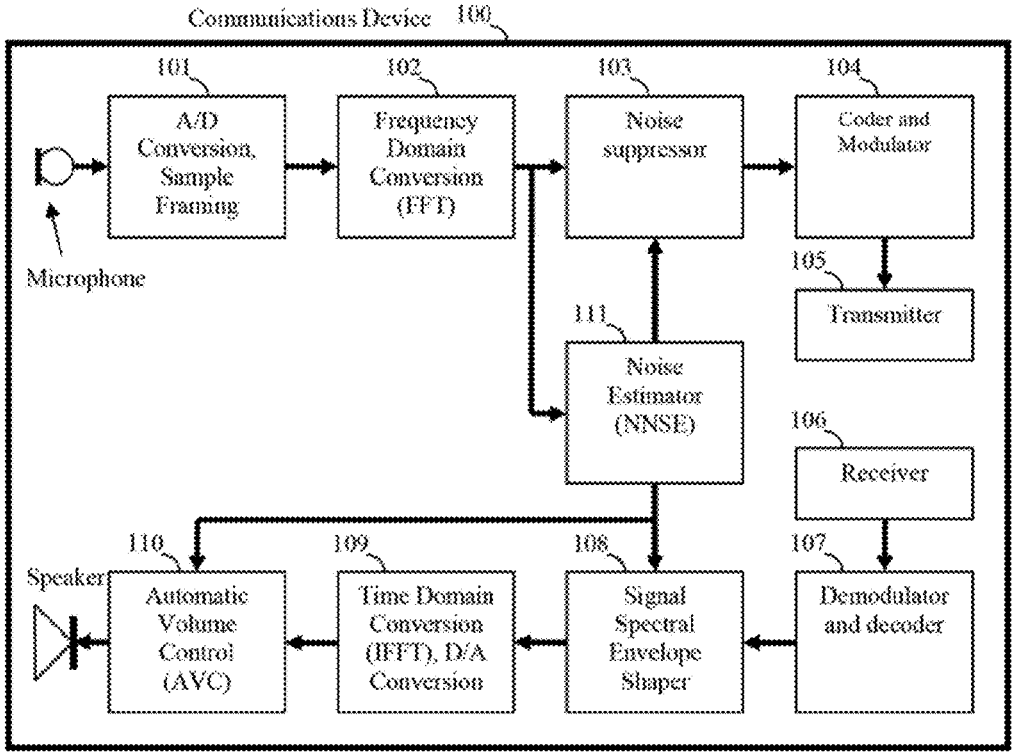

Figure 2. Block diagram depicting the major processes comprising the NNSE method.
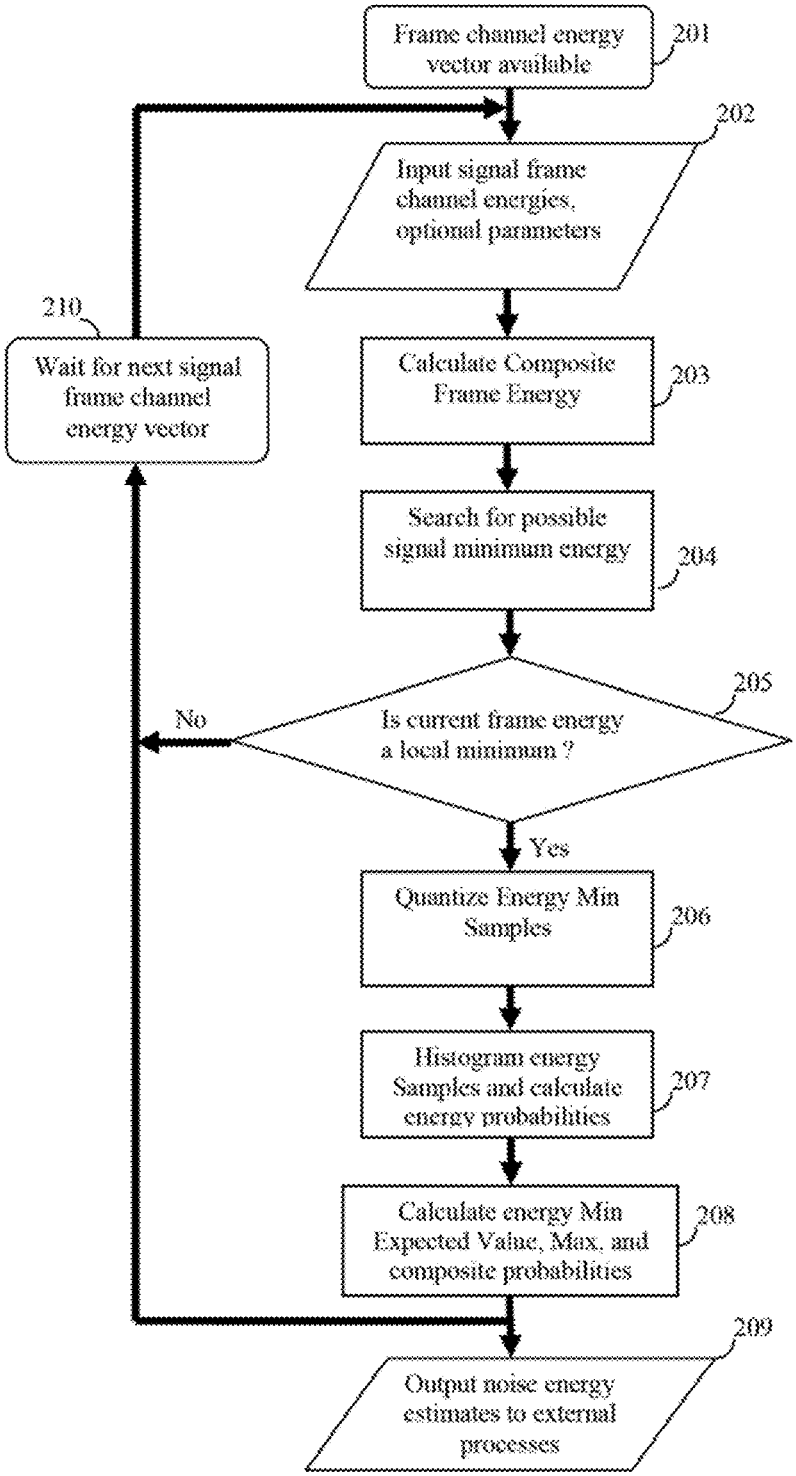

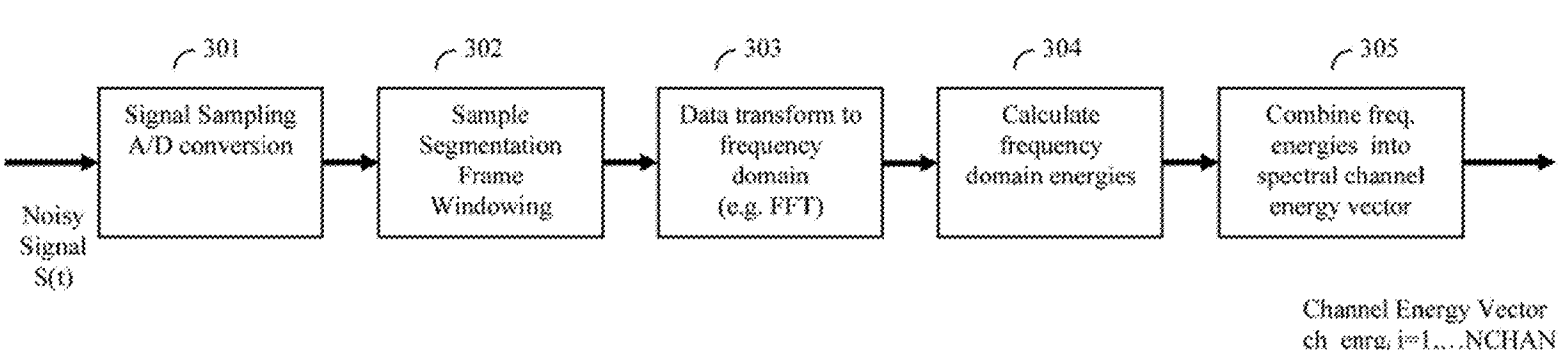
Figure 3. Block diagram depicting steps commonly performed to generate a signal data frame spectral channel energy vector. (Prior Art)

Figure 4. NNSE method process 1: parameter initialization and calculation of the current frame composite energy.
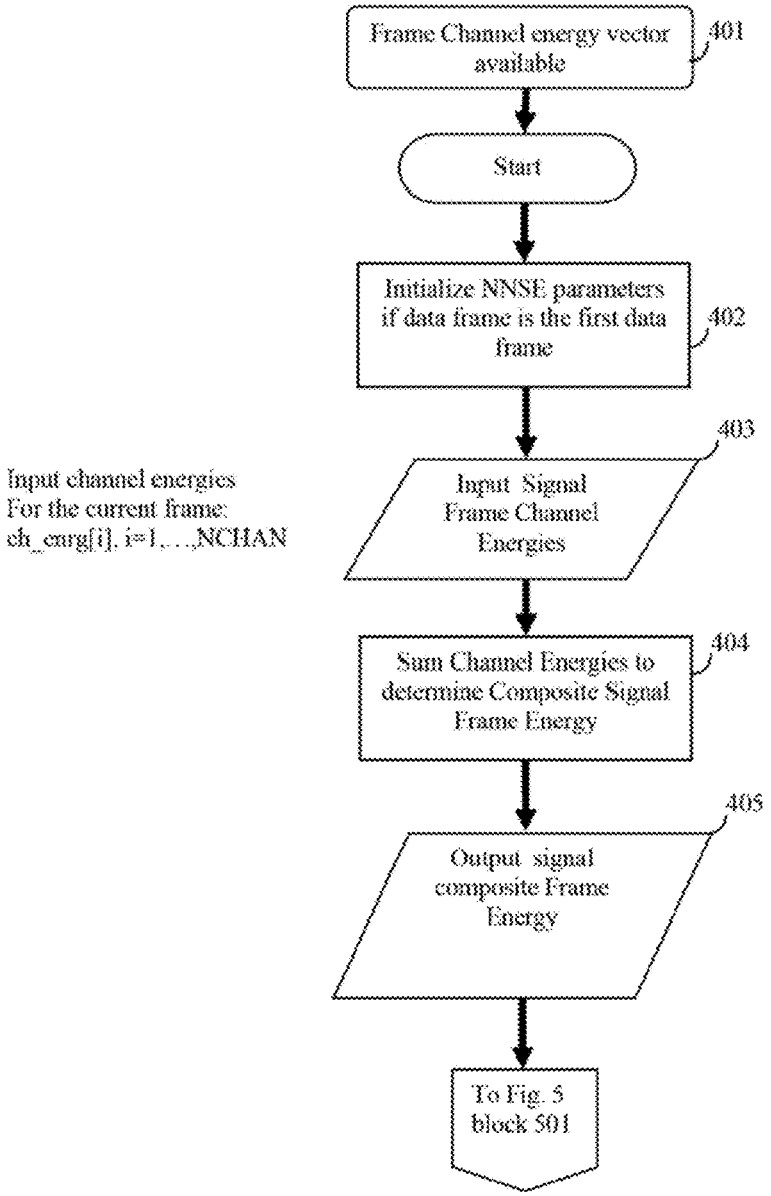

Figure 5. NNSE method process 2: description of the process for searching for, identifying, and tracking signal local energy minima.
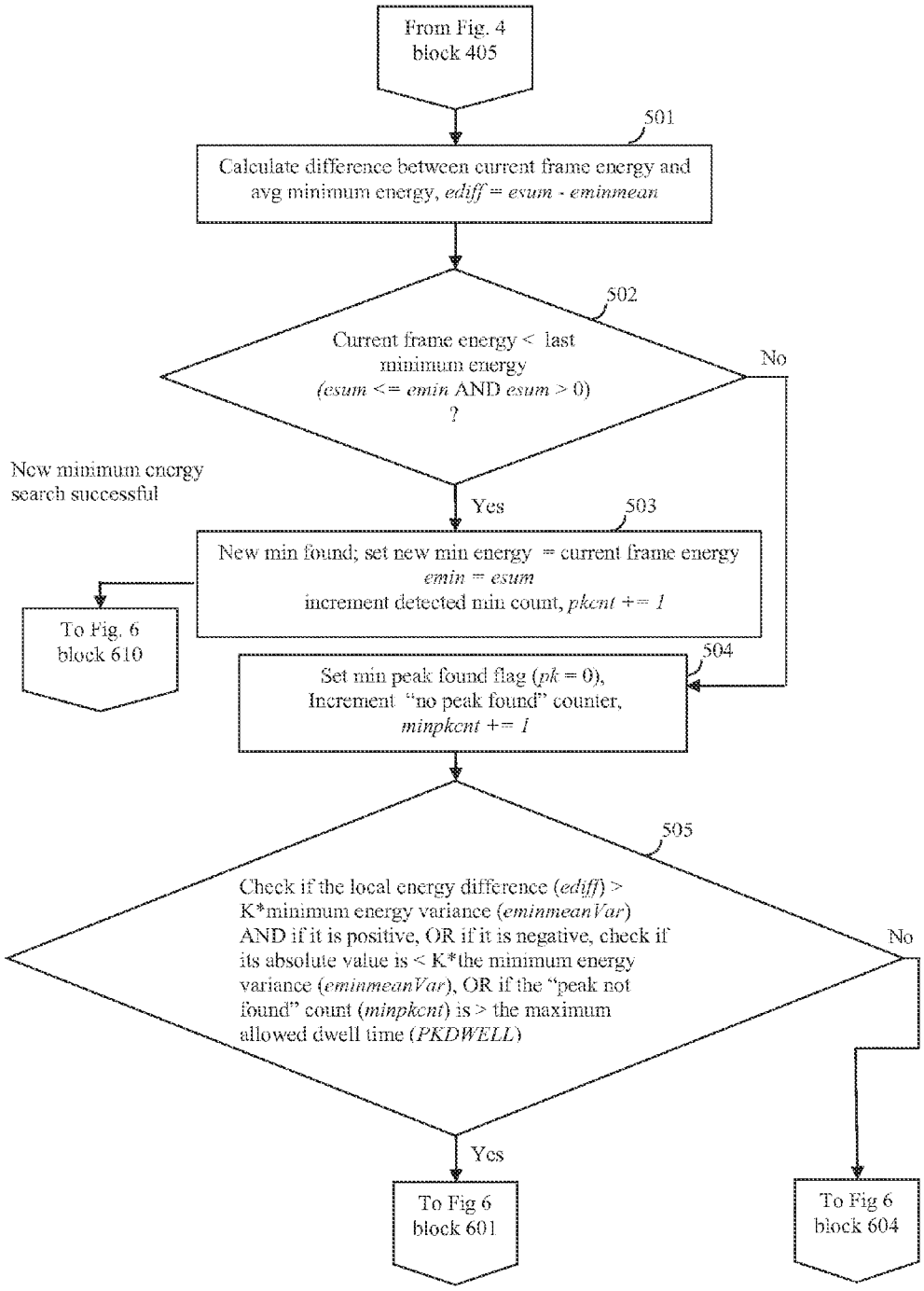

Figure 6. Continuation of Figure 5, NNSE method process 2: description of the process for searching for, identifying and tracking signal local energy minima.
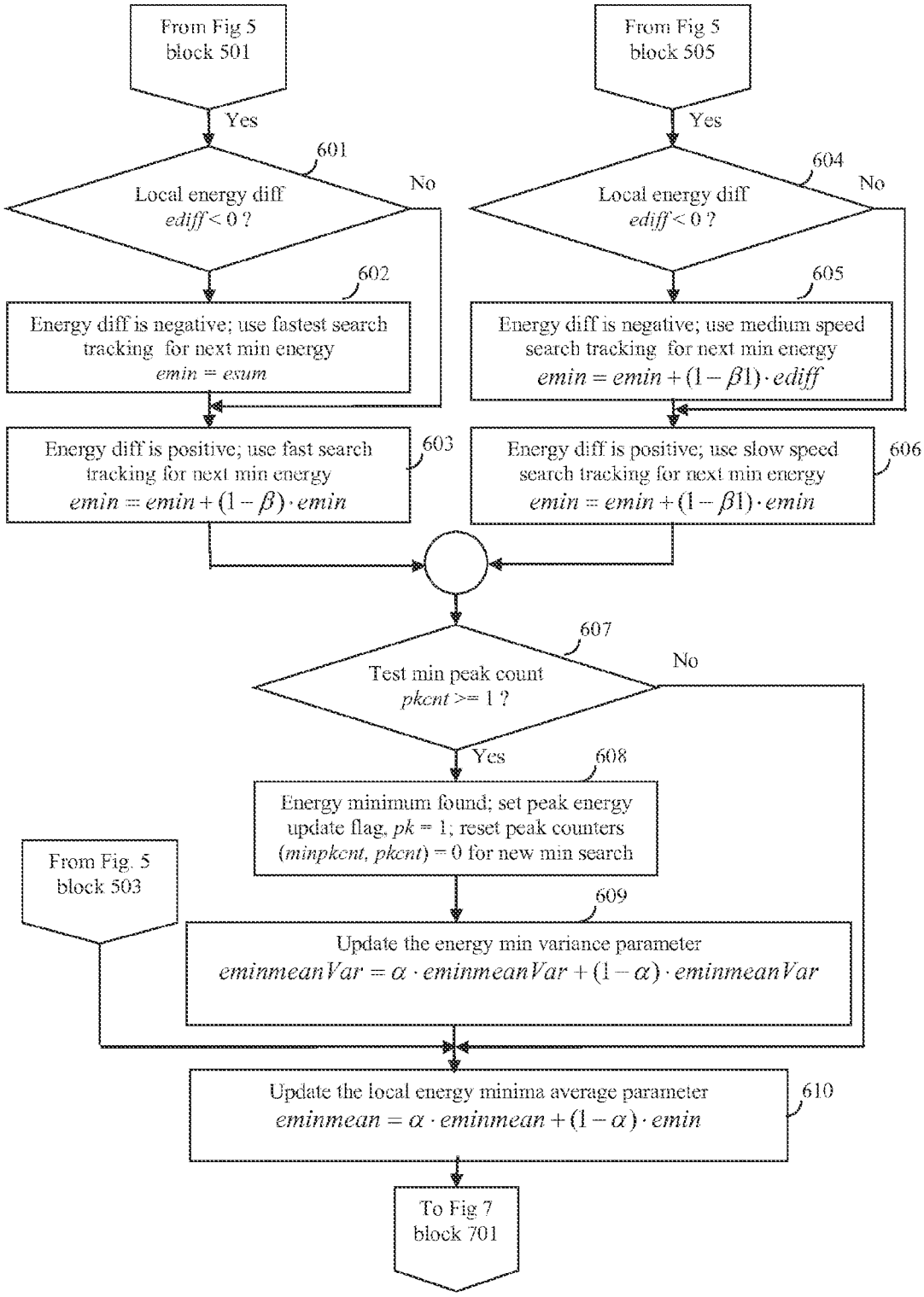

Figure 7. NNSE method process 3: start of the noise estimate update; quantization of the channel energies of the current frame identified as a signal local energy minimum and likely to be noise.
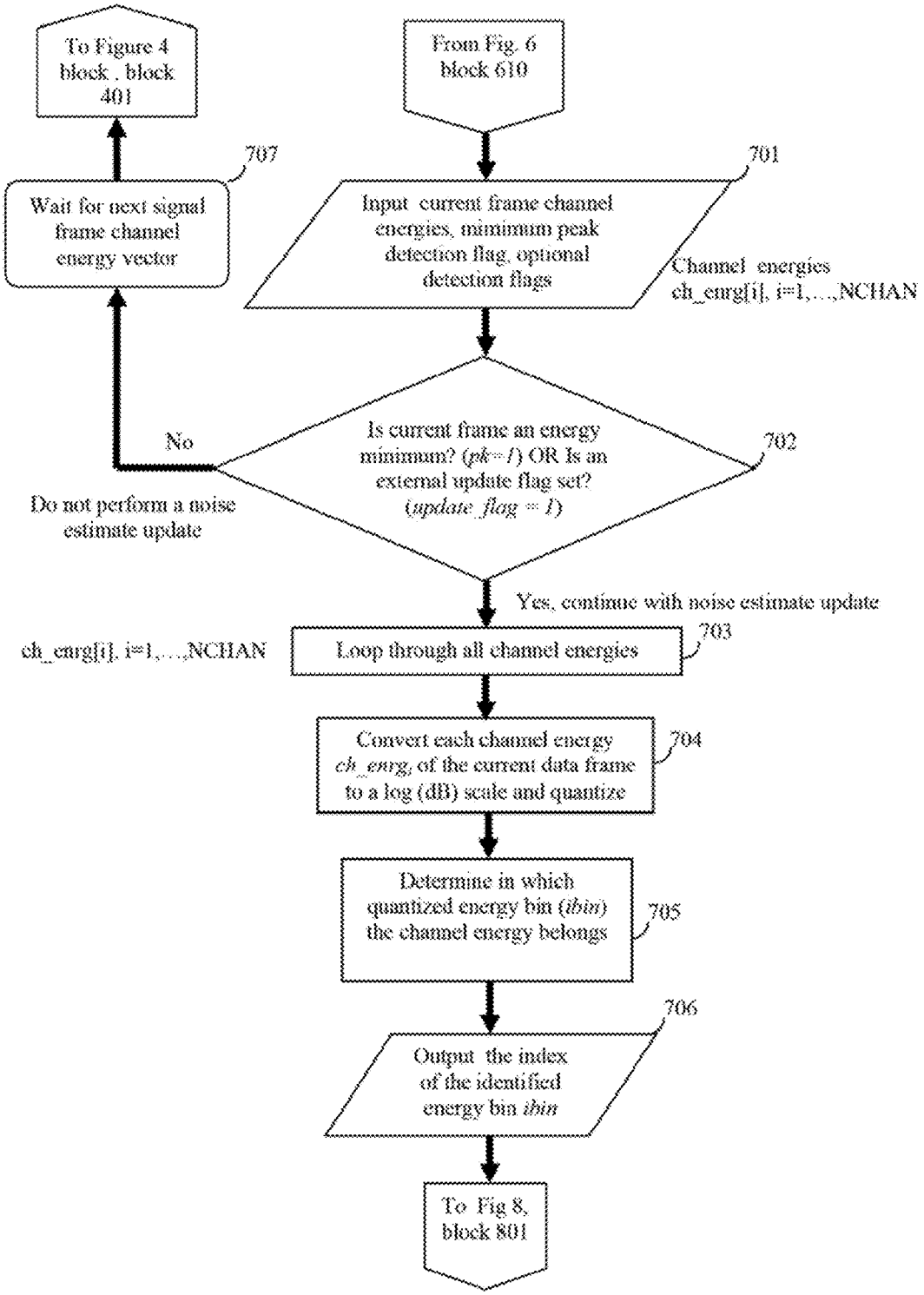

Figure 8. NNSE method process 4: histogramming the identified signal local channel energy minima and calculating energy occurrence probabilities.
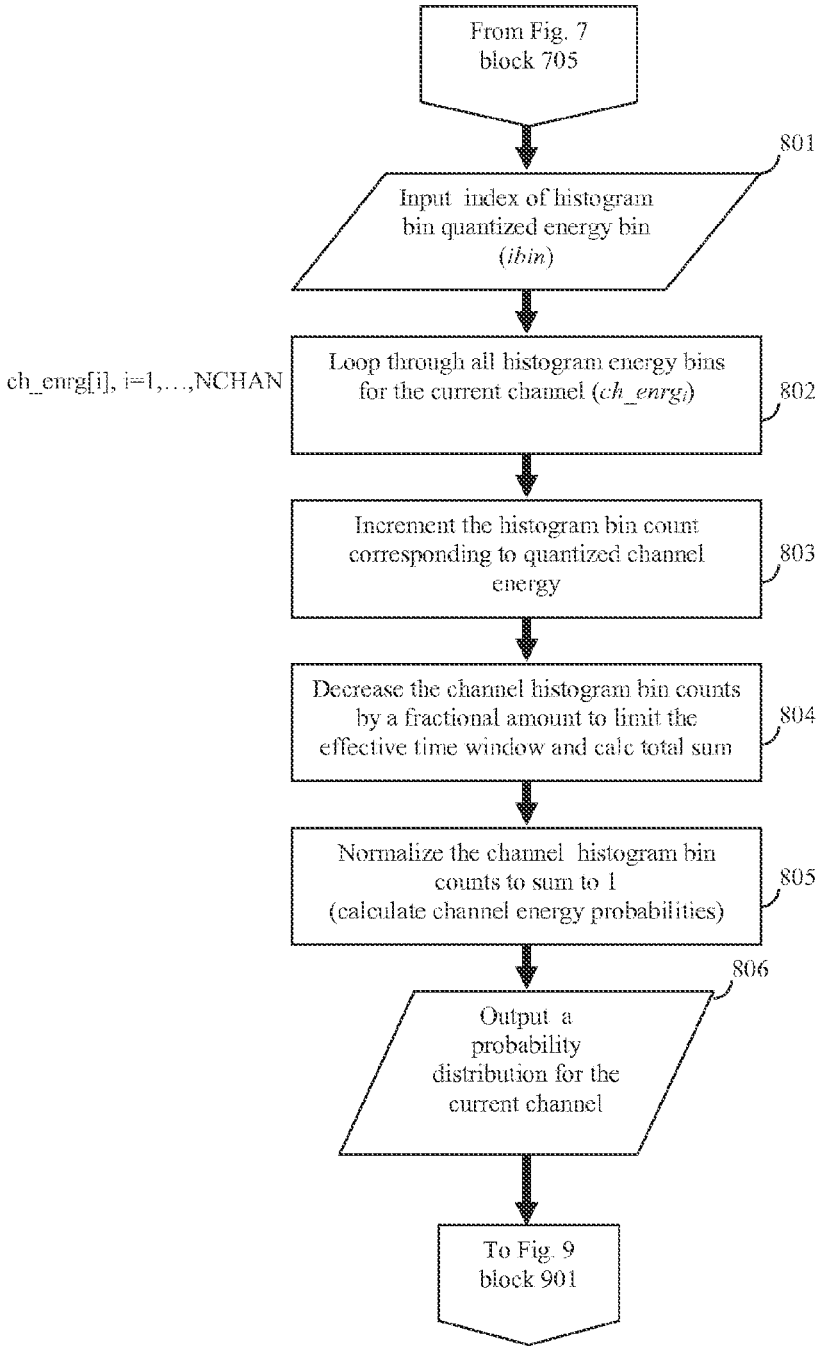

Figure 9. NNSE method process 5: calculation of the expected value, maximum probability, and composite estimate of the channel noise.
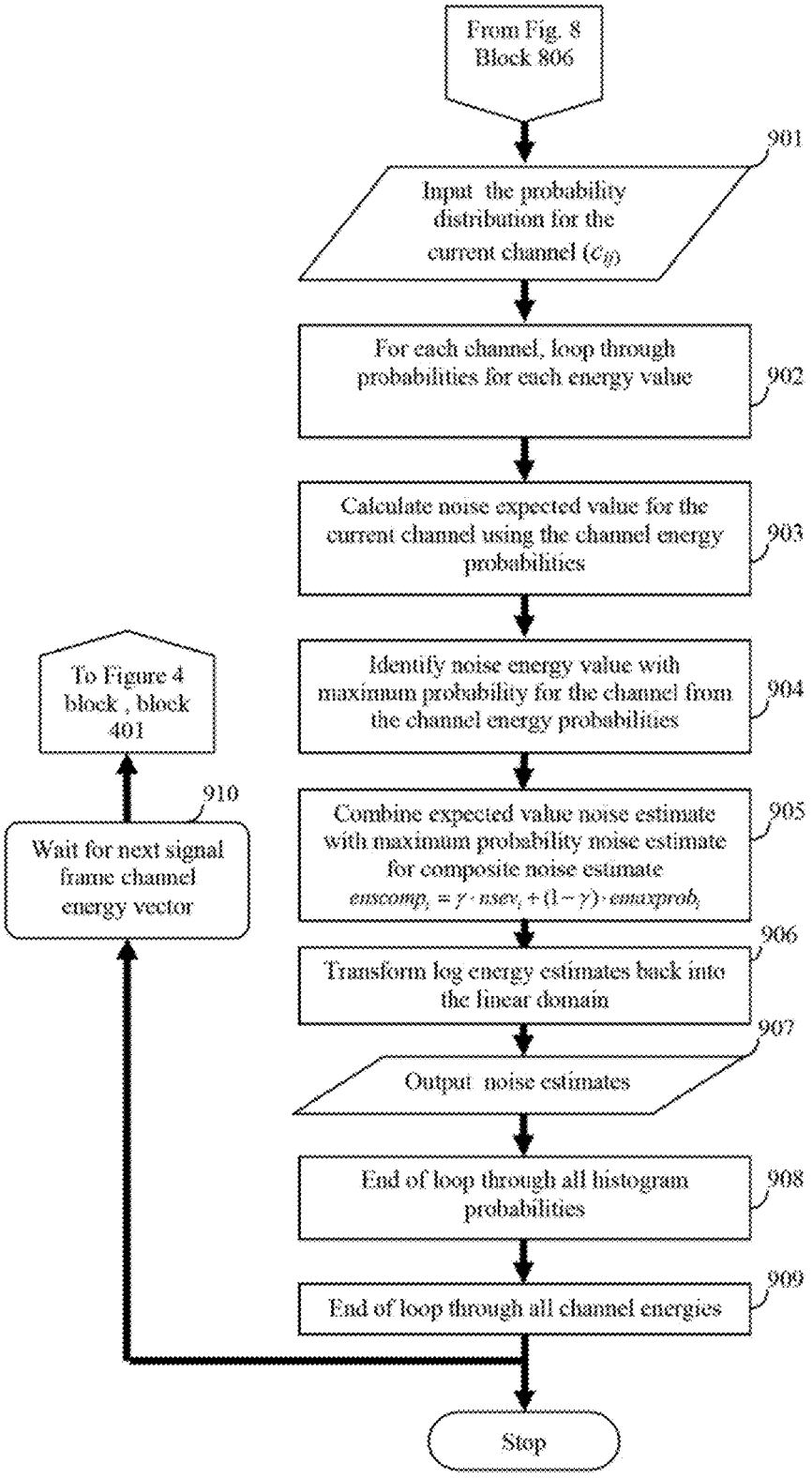

Figure 10. A plot depicting some parameters and the noise estimates from the IS-127 noise estimator in response to a speech signal contaminated with babble noise at a 6 dB SNR.
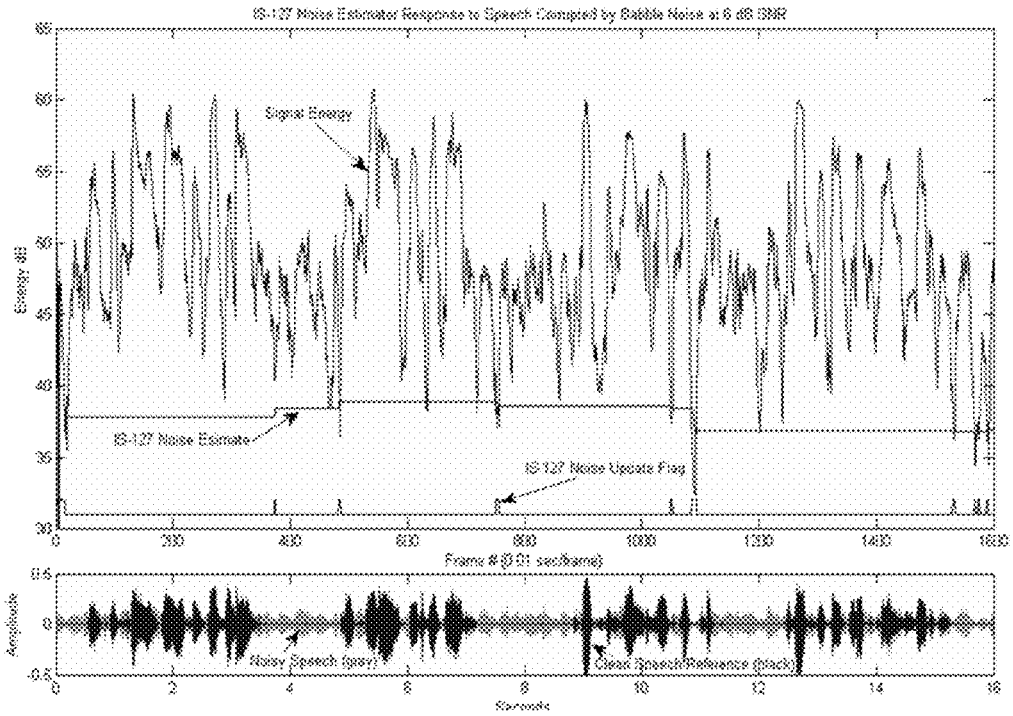

Figure 11. A plot showing some parameters and the noise estimates from the IS-127 and NNSE noise estimators in response to a speech signal contaminated with babble noise at a 6 dB SNR.
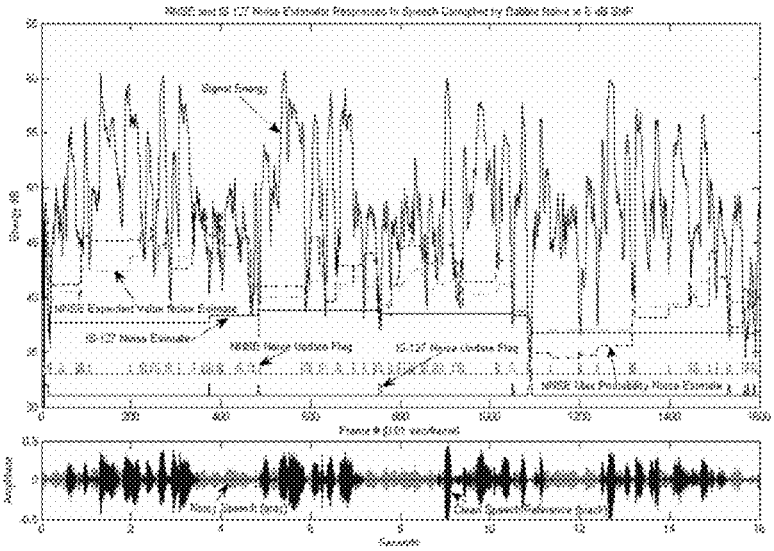

Figure 12. A second embodiment of NNSE method process 2: description of the process for searching for, identifying, and tracking signal local energy minima.
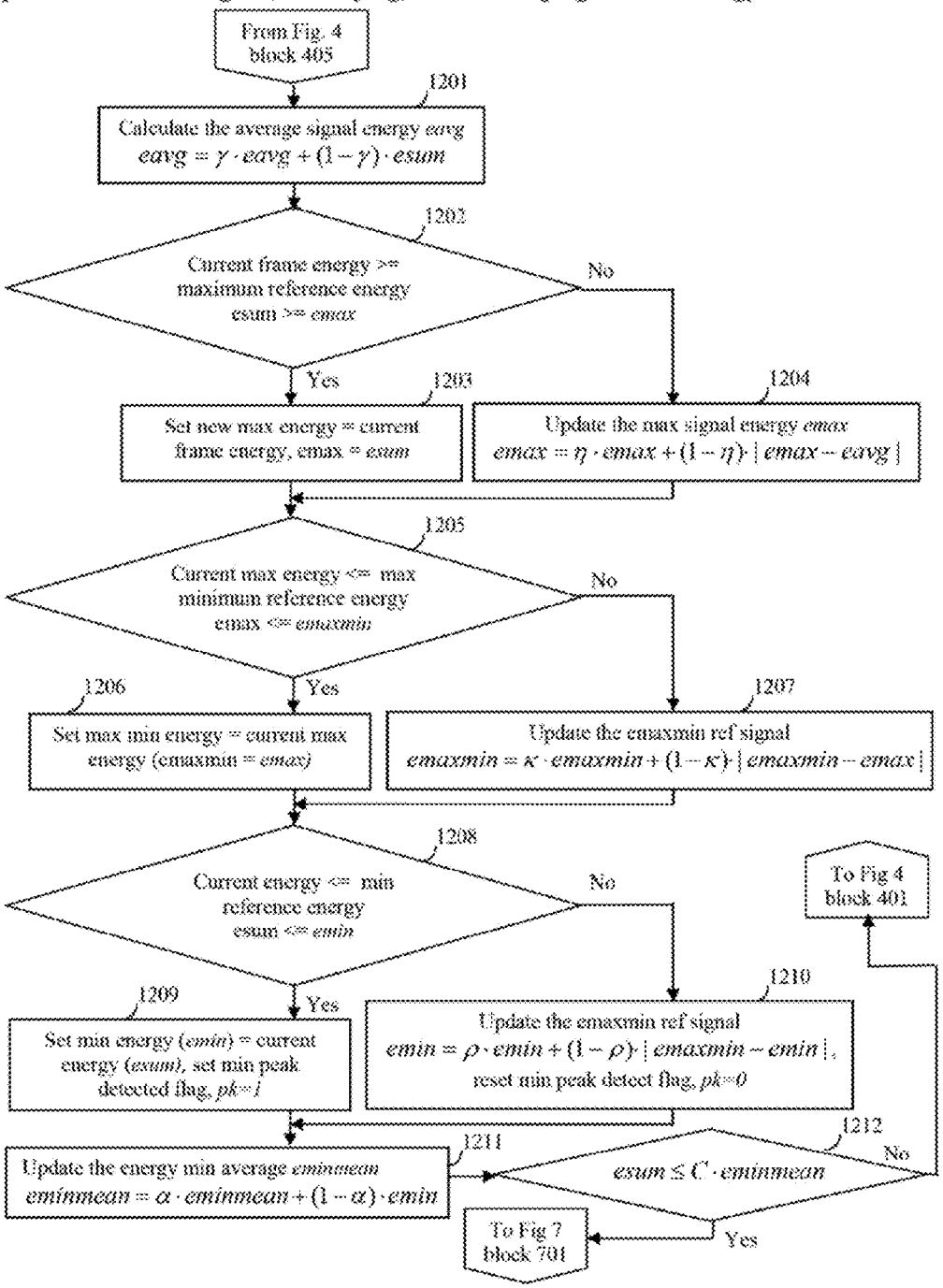

Figure 13. A plot depicting parameters and reference signals related to the second embodiment of the local energy minima search process of the NNSE method, generated in response to a speech signal corrupted by babble noise at a 6 dB SNR.
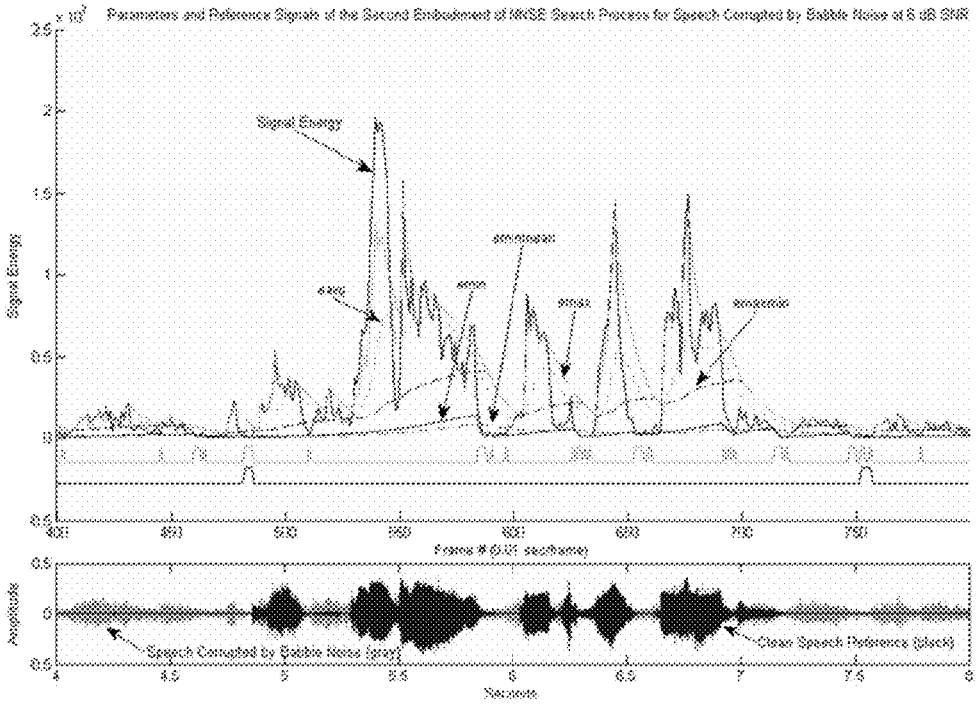

NONSTATIONARY NOISE ESTIMATOR (NNSE)

FIELD OF INVENTION

The present invention relates generally to the field of acoustic noise estimation. The present invention is more specifically directed to improving the estimation of non-stationary acoustic noise, noises with characteristics similar to those of speech, and particularly noise in signals that also contain speech.

BACKGROUND OF THE INVENTION

Mobile voice communications products are used in a variety of environments, many of which can be extremely noisy. Background noise masks the desired speech signal and reduces the intelligibility of the speech in both the sending and receiving environments. Many mobile voice communications products contain processing components that attempt to mitigate the effect of the noise on the speech signal. On the uplink transmit input side many products employ some type of noise suppression system to clean up a noisy speech signal before any coding or modulation is employed. Suppressing the noise improves the performance of a codec or modulator. Currently, many different noise suppression methods are used in voice communications products. Many are based on the IS-127 specified algorithm incorporated in the TIA/EIA-IS-127 standard EVRC codec (TIA/EIA/IS-127, "Enhanced Variable Rate Codec, Speech Service Option 3 for Wideband Spread Spectrum Digital Systems", July 1996), or on variations of it. The IS-127 noise suppressor belongs to the class of single input spectral subtraction noise suppressors in which an estimate of the spectral energy characteristics of the background noise is used to remove noise from the noisy speech signal.

On the downlink receive output side, some communication device products use automatic volume control (AVC), dynamic gain compression, or spectral shaping of the received speech output to improve the intelligibility based on the listener's ambient noise environment. Such a system is described by Song et al. in US20060270467 A1, Nov. 30, 2006, "Method and Apparatus of increasing speech Intelligibility in Noisy Environments" and depends on an accurate estimate of the background noise for its operation.

Paramount to the successful operation of noise-related processing techniques is an accurate, current, short-term estimate of the background noise spectral energy. By short-term is meant over the duration of meaningful segments of speech, i.e. syllables and words. For stationary or slowly changing random noise sources this not usually a problem since the mean noise energy is constant over a period that is long relative to the speech. The sample average noise closely approximates the expected value and can usually be determined from a few signal segments identified as not containing speech. For nonstationary noises this is not the case as the noise may change rapidly relative to the speech modulation rate, requiring that the noise estimate be updated much more frequently. In the case of non-stationary noises or speech-like noise such as babble noise, many currently used common methods for tracking and estimating the noise can be lagging or error-prone resulting in faulty operation of the communication device's noise processors that rely on an accurate noise estimate. Thus, accurate methods for estimating and tracking nonstationary noises are useful and necessary.

BRIEF DESCRIPTION OF THE DRAWINGS

FIG. 1 is a block diagram of one instance of how the invention may be incorporated into a communications device.

FIG. 2 is a block diagram of several processing components of the NNSE method.

FIG. 3 is a diagram of one conventional prior art method of generating a frequency domain channel energy vector from a time domain noisy signal.

FIG. 4 is a flowchart depicting an exemplary embodiment of how the frame energy is calculated for detection purposes.

FIG. 5 is a flowchart depicting how the search for local signal energy minima is performed.

FIG. 6 is a continuation of FIG. 5 flowchart depicting how the search for local signal energy minima is performed.

FIG. 7 is a flowchart depicting how the detected probable energy minima are quantized.

FIG. 8 is a flowchart depicting histogramming of the probable detected energy minima and the calculation of the probability distribution function estimate for the noise energy minima occurrences.

FIG. 9 is a flowchart depicting how the noise energy estimate is determined from the histogrammed data.

FIG. 10 is a plot of data calculated by the IS-127 noise estimator showing a noisy speech waveform with markers indicating the periods in which noise is sampled and the noise estimate.

FIG. 11 is a plot of the noise estimate from the IS-127 noise estimator as a reference and by the NNSE method.

FIG. 12 is a flowchart depicting a second embodiment of a minimum energy search process of the NNSE method.

FIG. 13 is a representative plot illustrating the reference signals used in the second embodiment of the search process used in the NNSE method.

DETAILED DESCRIPTION

A noise estimation method and apparatus is disclosed which provides improved estimation and tracking of nonstationary noise signals, noises with spectral and temporal characteristics that resemble speech (i.e. speech-like audio), and such noises that may also contain a speech signal. Accordingly, the method includes searching for a local minimum energy over a plurality of frames using at least two reference signals including a first signal comprised of a time-sensitive current local minimum energy estimate, emin, and a second signal comprised of a time-weighted average of previous detected local energy minima, eminmean; and deciding whether the detected local energy minima of the first reference signal is a noise signal. Also, binning the detected input signal energy minima values within a plurality of histograms; and calculating a composite noise energy estimate comprised of a weighted sum of a maximum probability noise energy estimate and an expected value noise energy estimate. As such a nonstationary noise estimator is formed.

Additional innovation encompassed by one or more embodiments also include an energy peak tracking method to identify and track signal energy minima in a continuous noisy signal; a method for determining the probability distribution of the detected signal energy minima in a time sensitive manner; and a method for determining a time sensitive estimate of the noise energy spectrum and some of its statistics.

One or more embodiments are described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

An illustration of generally how a noise estimator may be included in a communications device is shown in FIG. 1 block 100. In block 101 a talker's voice signal picked up from a microphone device is amplified, digitally sampled by an A/D converter, and groups of samples are assembled into consecutive fixed length segments of data called frames. In block 102 each consecutive time data block is converted into the frequency domain by some method such as a Fast Fourier Transform (FFT) or filterbank to form a frequency domain representation of the data frame in the form of a vector of frequency channel energies. In block 103 the frequency channel energy vector is processed by a noise suppression processor to remove some of the signal noise. The frequency channel energy vector is also passed to a noise estimation processor in block 111 that determines characteristics of the ambient background noise surrounding the talker and picked up by the microphone. The noise parameter estimate produced by the noise estimator in block 111 is used by the noise suppressor in block 103 to suppress the noise. In FIG. 1 block 104 the noise-reduced frame data is coded by a digital vocoder and modulated before being transmitted in block 105. On the receive side of the communications device a signal is received by block 106 and demodulated and decoded by block 107. From here the decoded voice signal may be further enhanced by a spectral shaping processor in block 108 to improve the quality of the voice signal for a listener based on his ambient noise environment. This processor will enhance specified frequencies depending on the spectral shape and magnitude of the ambient noise as determined by the noise estimator in block 111. In block 109 the signal is converted back into the time domain via an inverse method of block 102 such as an inverse FFT (IFFT), and converted back into an analog signal via a D/A converter. The received signal may then be sent to an automatic volume control (AVC) processor in block 110 containing a variable gain amplifier that automatically controls the volume of the speaker output signal based on the ambient noise measurement provided by the noise estimator in block 111.

The NNSE method, described herein as one or more exemplary embodiments, includes at least five processing components: a signal composite energy calculator, a signal energy minimum tracker, an energy quantizer, a histogram energy probability estimator, and a noise estimator. These components are depicted in FIG. 2 in blocks 203, 204, 205, 206, 207, and 208. Both required signal input parameters and optional parameters that are employed by the NNSE method are represented in FIG. 2 block 202 and parameters output from the NNSE method are depicted in block 209. Blocks 201 and 210 represent processes and events that can be external to the NNSE method.

The effectiveness of a noise estimator used in a voice communication system depends on a number of factors including the method used and the characteristics of the noise. Accurate estimates of some nonstationary noises are limited by the degree of variability relative to the analysis frame duration, and the presence of speech. For single input systems the noise may be difficult to accurately measure continuously when speech is present. For example, the noise estimator employed in the commonly used IS-127 based noise suppressor, referenced above, is a single input method that relies on a VAD (Voice Activity Detector) to determine which analysis frames are likely to contain speech and which contain only noise. The information from the identified noise frames is averaged over a period of time to form a noise estimate. The single input VAD analysis means that the noise estimate will only be updated intermittently when speech is determined not to be present. For nonstationary noises, or for speech-like noises that the VAD fails to detect as noise, this means that the noise estimate may at best be lagging the true current noise, or is inaccurate, if the noise is changing rapidly relative to the speech.

Many noise estimators such as the estimator employed in the commonly used IS-127 noise suppressor are conservative in nature, tending to exclude any signal frame that could possibly contain speech, less the noise estimate become contaminated. They exclude noises that have speech-like spectral characteristics and incur additional delay in making VAD decisions to exclude sudden changes in noise that may be confused as speech. These noise estimates tend to be made using a long-term average of identified past noise samples which also makes the estimator slow to respond. Also, noise estimators such as the estimator employed in the commonly used IS-127 noise suppressor are designed to work at higher signal-to-noise ratios (SNR) levels, generally above 10 dB, and with stationary or slowly changing noises. At lower SNRs, in cases where the noise has speech-like qualities, or where the noise is changing rapidly, the VAD speech/noise decisions are prone to error resulting in inaccurate noise estimates. The NNSE noise estimator described here is designed to overcome some of the limitations of previous noise estimators.

The NNSE noise estimator may be configured as a standalone device in which case proper input and output data processors are added. However, for one exemplary embodiment, the NNSE noise estimator is expected to input and output properly formatted data from a system in which it is embedded such as illustratively depicted in FIG. 1. In one embodiment for example, a primary signal input to the NNSE method is in the form of a vector of spectral energies representing each limited time segment of an input signal, obtained from some device or processor source external to the NNSE processor (e.g. FIG. 1 blocks 101 and 102). Additional optional information may also be input to the NNSE method. This optional information may include signal related parameters such as the energy representing a limited time segment of a noisy signal, or information from other processors such as the VAD information generated in a separate noise estimator such as the one described in TIA/EIA/IS-127, "Enhanced Variable Rate Codec, Speech Service Option 3 for Wideband Spread Spectrum Digital Systems", July 1996, that may also be a component in a communications device. This optional input information may be used to enhance the performance of the NNSE method, but is not necessary for its operation. These input parameters are included by reference in the block numbered 202 in FIG. 2.

The spectral energy vector is representative of the energy of a finite time segment of a noisy time domain signal, transformed into the frequency domain and partitioned into a plurality of frequency bands, herein referred to as channels, each vector element representing the signal energy in a channel. The processes for obtaining a vector of spectral energies representative of a segment of a time domain signal are well known to those skilled in the art. In an exemplary embodiment, the vector of spectral energies, herein also referred to as channel energies with each vector element representing a spectral channel, are input to the NNSE method from another processor in a time sequential manner. However, the spectral energy vector may also be calculated as part of the NNSE method. As an example of obtaining the spectral energy vector, the steps of one conventional method are illustrated in FIG. 3, blocks 301, 302, 303, 304, and 305. The desired time domain electrical signal is digitally sampled (block 301). The signal samples are segmented into blocks of data of defined length corresponding to a defined length of time. A window function is applied to each data block and the data blocks may be allowed to overlap in time for the purpose of providing a smoother spectral estimate (block 302). Each windowed data block is referred to as a frame. The frequency spectrum of each frame of data can be determined via a DFT (Discrete Frequency Transform), FFT (Fast Fourier Transform), or by some other method (block 303). The energy spectrum is calculated from the resultant magnitude and phase parameters (block 304). The energy spectrum may be further partitioned by summing groups of consecutive FFT frequency energies into smaller groups referred to as channels to form a vector of energies representing bands of the spectral energy distribution of a particular data frame at a particular time (block 305). In another conventional method, the spectral vector energies may also be obtained in the time domain by calculating the energies of the outputs from a bank of frequency specific band pass filters. This representation has also been referred to as a filterbank. Other methods of calculating a spectral energy vector are well known in the art such as those used in the TIA/EIA-IS-127 standard EVRC codec (TIA/EIA/IS-127, "Enhanced Variable Rate Codec, Speech Service Option 3 for Wideband Spread Spectrum Digital Systems", July 1996), or in Ashley, U.S. Pat. No. 5,659,622, or in Vilmer, et al, U.S. Pat. No. 4,811,404 and are incorporated herein by reference.

The first process in the novel and inventive NNSE noise estimation method is to calculate a composite measure of the signal energy for the current (immediate) signal frame by summing the energies of selected frequency channels of the frame channel energy vector. These process steps are depicted in FIG. 2 block 203 and in FIG. 4 in blocks 402, 403, 404, and 405. The intent here is to obtain a representation of the current frame signal energy for detection purposes. In an exemplary embodiment, the channel energy vector, $ch_enrg_i$, i=1, . . . , NCHAN, composed of NCHAN elements and representing the energy of the current signal frame in the frequency domain, is either input from a process external (FIG. 4 block 401) to the NNSE method (FIG. 4 block 403) or is calculated by a conventional method referred to previously (FIG. 3). Note that a parameter initialization step occurs in block 402 that is executed only for the first input data frame. The purpose of this block is to initialize specific reference parameters that are used in later calculations. After the first data frame is processed these reference parameters are automatically updated by subsequent frame data processing.

In the preferred embodiment all of the channel energies are summed and represent the total current frame signal energy. However, a partial energy representation may alternatively be calculated by summing only a subset of the channel energies. This may be desirable if certain signal channel energies are constant and dominant, to help track underlying changes in the signal. The summing operation corresponding to FIG. 4, block 404, for the total signal energy is given by:

$$esum = esum + ch_enrg_i,\ i = CHAN_n, \ldots, CHAN_m, \qquad \text{Eq. 1}$$

where esum is the sum of the channel energies over some specified bandwidth from $CHAN_n$ to $CHAN_m$ which can be the whole channel energy vector or some subset of it. Thus, the parameter esum represents a composite measure of the signal energy at the present frame time and is thus time-sensitive. It should be noted that the esum parameter may be calculated outside of the NNSE method by an external process and input as an optional parameter. In this case, the calculation specified by Equation 1 is unnecessary and can be eliminated to save computation. esum is only used to track the signal energy minima.

The next process in the NNSE method is to identify and track the signal local energy minima. The local minima occur during short pauses in a speech signal and represent the background noise. The process steps are depicted in flowchart form in FIGS. 5 and 6. The procedure for finding and tracking the signal energy minima is broken into three parts. The first part contains steps to recognize and detect an energy minimum peak and comprise the blocks in FIG. 5, 501, 502, 503, and 504. In block 501 the current frame composite energy esum determined as in FIG. 4 is compared with the running average of previously identified local minima (eminmean) by calculating their difference, ediff eminmean is a time-weighted average of previously identified local minima and represents an estimate of the noise energy used as a reference. emin is the local minimum signal reference value which tracks the current detected minimum signal energy. Note that initial values for eminmean, emin, and certain other variables, parameters, and flags are instantiated in FIG. 4 block 402 once, after the first data frame is received. If the composite current frame energy esum is less than the current average energy minimum eminmean and greater than zero, a local energy minimum has been detected and a "possible" new true energy minimum has been detected. The energy minimum identification is conditional, since the next input frame energy may be lower still, if the signal energy is decreasing. This test is represented in block 502. If the test condition of block 502 is TRUE the current energy minimum tracking variable emin is updated to the current frame esum value, and a detected local minimum energy peak counter, pkcnt, is incremented as in block 503. This counter keeps track of the number of consecutive relative energy minima detected. However, a positive value for pkcnt does not necessarily mean that a true energy minimum has been found. When a new minimum energy is detected the immediate search is suspended until the next input frame to determine if it is indeed a true energy minimum, and the program flow jumps to the updating of the energy minimum average, eminmean, at block 610 in FIG. 6. Thus eminmean represents an average of local energy minima as a detection reference.

If the result of test block 502 is FALSE, esum is greater than the current energy minimum value emin meaning the local energy is rising relative to the current minimum energy value, a search for the next local energy minimum commences. In this case, the current frame energy esum is now known not to be an energy minimum and the minimum peak energy detection flag, pk, is set to zero. Also, a counter minpkcnt that counts the number of consecutive data frames (time period) in which an energy minimum was not detected is incremented. These steps are represented by block 504. The purpose of the counter minpkcnt is to indicate the possibility that an abrupt increase in the noise level may have occurred and that the search for the new noise level energy minimum should be accelerated. The above steps are described in the following pseudo-code:

Minimum Peak Detection Pseudo-code

```
    ediff = esum − eminmean
    Block 501
    if (esum <= emin AND esum > 0.0)
        Block 502
      {
    emin = esum
        Block 503
    pkcnt = pkcnt + 1
    GO TO eminmean update step in block 610
  }
  else      /* minimum energy not detected, start or continue search */
  {
    pk = 0
        Block 504
    minpkcnt = minpkcnt + 1
    GO TO block 505 to determine search rate
  }
```

The next task in the minimum energy search process is to adjust the value of the current reference minimum energy variable emin at a prescribed rate until eminmean matches the energy of the current frame input signal energy esum. Note that the detection variable eminmean is determined by the values of the minimum tracking variable emin (FIG. 6 block 610). The minimum tracking variable, emin, is a current estimate of the signal local energy minimum so if there is a sudden increase in energy, say due to the presence of a speech signal, emin is not allowed to increase immediately, but is instead allowed to increase at a slower controlled rate for a period of time until the speech energy has likely diminished back to near the background noise level. Speech energy rises and falls rapidly with an average modulation rate of between 4 and 5 Hz, so speech energy minima are likely to occur most often every 0.2-0.25 seconds. On the other hand, if the increase in input signal energy is due to an increase in the noise it is desirable that emin adapt quickly and the adjustment rate should be increased. The rate at which emin is allowed to adjust to track the signal energy in the NNSE method takes into account the natural fluctuations of speech energy and other factors.

The overall energy minima search and tracking process is data frame-synchronous, but the rate at which the emin reference variable is allowed to adjust per data frame is controlled by other factors as described above. The steps that determine the energy minimum search tracking rate in the NNSE method are depicted in FIG. 5, block 505, and in FIG. 6 blocks 601 through 607. In these steps the current energy minimum tracking variable emin is increased or decreased frame synchronously until the conditional test of block 502 is again satisfied (i.e. a new local energy minimum is detected).

There are four different rates at which the minimum energy reference variable emin is allowed to increase or decrease. Different rates are used to deal with different noise energy variations (i.e. slow changes, fast changes, positive or negative) and the possible presence of a speech signal. The selected adaption rate is dependent on the sign of ediff; whether signal energy esum is increasing or decreasing relative to the current eminmean value; if ediff exceeds the average variance of the detected energy minima (eminmeanVar); and if a local energy minimum has been recently detected (pkcnt>=1). The rate selection decision test is depicted in FIG. 5 block 505, and in FIG. 6 blocks 601 and 604.

The tracking rates of the emin reference variable are determined via simple exponential smoothing functions with specified time constants. The steps of selecting a specific tracking rate are described in blocks 601 through 606. Pseudo-code corresponding to NNSE method process steps 505, 601, 602, 603, 604, 605, 606, and 607 is shown below.

Minimum Peak Search Rate Determination Pseudo-code

```
if ((ediff < 0.0 AND abs(ediff) > K*eminmeanVar AND emin > 0.0)
  OR (abs(ediff) < K*eminmeanVar) OR (minpkcnt > PKDWELL))
      Block 505
  {
If (ediff < 0.0)
      Block 601
  {
    emin = esum                          /* very fast search rate */
      Block 602
  }
  else
  {
    emin = emin + (1 − β)*enzin          /* fast search rate */
      Block 603
  }
}
else        /* use slower search rates to avoid tracking speech */
  {
    If (ediff < 0.0)
      Block 604
  {
    emin = emin + (1 − β1)*ediff         /* medium search rate */
      Block 605
  }
  else
  {
    emin = emin + (1 − β1)*emin          /* slow search rate */
      Block 606
  }
}
```

Referring to the pseudo-code above and to FIGS. 5 and 6, if the test condition of block 505 is TRUE it means that the signal energy is decreasing and has exceeded the variance of the detected energy minima over a recent past defined period of time. It also is TRUE, if the dwell time since the last energy minimum was detected has been exceeded (minpkcnt>PKDWELL) indicating that the noise level has likely changed abruptly and exceeded the expected variance of the previous minimum energy. In either case it is desirable to track the signal energy at a fast rate. In block 601, if the energy difference ediff is negative it means that the signal energy is decreasing, so the fastest tracking rate is used setting emin to the current signal energy esum as shown in block 602. Else, if ediff is positive it means the signal energy is increasing quickly, but may be due to a transient or to a speech signal, so a slightly slower tracking rate is used as determined by the time constant β as in block 603, thereby making ediff time-sensitive. One example uses the value of β of 0.8, but other values are also possible to control the emin adaptation rate.

If the test condition of block 505 is FALSE, it means that the signal energy is increasing and has not exceeded the variance of the recent detected energy minima. In this case, it is desirable to track the signal energy at a slower rate since the noise energy changes are within normal variance. In block 604, if the energy difference ediff is negative it means that the signal energy is decreasing, but has not exceeded the variance of the energy minima eminmean, so a medium speed tracking rate, proportional to the energy difference ediff is used as shown in block 605. Else, if ediff is positive it means the signal energy is increasing so a slow tracking rate is used determined by the time constant β1 as in block 606. For one embodiment the value of β1 is 0.99 but other values are also possible. The values of β and β1 are determined empirically to minimize detection errors when speech is present. The value of a multiplicative constant K of block 505 helps set the detection threshold based on the noise variance eminmeanVar and may be assigned a value between 1.0 and 2.0. This value may also determined empirically. Note that the search tracking rate used for adjusting emin can change abruptly based on changes in the signal energy as determined by the logical states produced by the conditional tests of blocks 505, 601, and 604.

Once the search tracking rate has been set a decision is made as to whether the current locally determined energy minimum is indeed a true minimum. If a minimum peak was detected in the previous frame (pkcnt>=1), but not the current frame (ediff<0.0, since esum>emin) it means that the previous frame was a true relative energy minimum, since the signal energy is no longer decreasing and has started to increase. In this case, steps are taken to set the signal energy minimum peak detection flag pk=1, reset the minpkcnt and pkcnt counters to zero, and update the variance estimate of the average minimum energy, eminmeanVar. These steps are depicted in FIG. 6 blocks 607, 608, and 609. The pseudo-code for these steps is given below.

Minimum Peak Flag, Parameter Update Pseudo-code

```
if (pkcnt >= 1)
        Block 607
  {
    pk = 1
        Block 608
    pkcnt = 0
    minpkcnt = 0
    eminmeanVar = α *eminmeanVar +
                (1.0 − α)*abs(emin − eminmean)
        Block 609
    }
```

Note that the variable eminmeanVar is a measure of the variance of parameter eminmean, the time weighted average of the detected minimum energy peak values, and is approximated by a simple smoothing function in block 609. An exemplary value of smoothing parameter α is 0.8 corresponding to a time relevance window duration of about 0.1 seconds as determined empirically.

The final step of the parameter search and update process is the update of the time average of the detected signal energy local minima, eminmean. The exponential smoothing function is given by Equation 2 and depicted in FIG. 6 block 610.

$$eminmean=\alpha*eminmean+(1.0-\alpha)*emin. \quad \text{Eq. 2.}$$

Block 610

Once a minimum energy data frame likely to be noise is identified, the next exemplary task in the NNSE method incorporates the data frame channel energy information into the running noise estimate. NNSE method process steps to accomplish this incorporation are illustratively depicted in FIGS. 7, 8, and 9. However, the noise estimate is updated and this set of NNSE method processes is executed only if certain pre-conditions are met. Otherwise, no update of the noise estimate is performed and the NNSE estimator waits for the next new frame of input data starting at block 210 in FIG. 2.

Needed information from the previous NNSE method steps is passed to the next step in FIG. 7 block 701. The conditional test used to determine if the noise estimate is to be updated is exemplarily depicted in FIG. 2 block 205 and in FIG. 7 block 702. The pseudo-code for the test is given by:

Noise Update Decision Test Pseudo-Code

If (pk=1 AND update_flag=1)

Block 702

Parameter pk is the minimum energy peak detection flag whose state is determined as in block 608 of FIG. 6 and is set to 1 only if a minimum energy peak is detected as described above. Optionally, a second flag labeled update_flag, can also be used to control the noise estimate update. This flag can be generated by a process external to the NNSE method such as, for example, the VAD update flag generated in TIA/EIA/IS-127, "Enhanced Variable Rate Codec, Speech Service Option 3 for Wideband Spread Spectrum Digital Systems", July 1996. This alternative control flag is sometimes useful in controlling the update of the noise estimate, but is not necessary to the operation of the NNSE method.

If a noise estimate update is not warranted as according to the test of block 702, further processing is suspended and the method waits for the input of the next data block as shown in block 707. If an energy estimate update is warranted as determined by block 702, program control proceeds to the noise estimation process steps of the NNSE method. Note that the noise estimation steps are performed using the frame energy channel energy vector rather than the composite frame energy used for the energy minima detection and tracking processes. The goal of the next NNSE method process is to form a distribution histogram of the detected true energy minima values over a specified time period. The first step in this task is to transform the original input data frame channel energies into the log domain and quantize them. These steps comprise the third process of the NNSE method and are depicted in FIG. 7 blocks 703 through 706. The steps of log transformation, quantization, and bin index identification (blocks 704 and 705) are done to compress the dynamic range of the energy data and to reduce the number of histogram bins that need to be processed. In one embodiment a log base 10 transformation is used, but other log bases can also be used. Also, the number of histogram bins is set to 90 with a resolution of 1 dB, thus providing a 90 dB energy dynamic range. More or fewer bins can be allotted with fewer bins providing coarser energy resolution but also requiring fewer computations. The log transformation and quantization is performed sequentially for each element of the channel energy vector $ch_enrg_i$, i=1, . . . , NCHAN. Note that the number of channels can be comprised of a single element that represents the total composite signal frame energy. This may be useful in systems that do not require a noise energy estimate for a plurality of frequency channels and thus will greatly reduce the amount of computation required. The log transformation, quantization, and bin index identification are performed according to the following equations:

$$chenrgdB=10\log(ch_enrg_i),\ i=1,\ldots,NCHAN \quad \text{Eq. 3}$$

Block 704

$$ibin=(int)(chenrgdB/dbstep), \quad \text{Eq. 4}$$

Block 705 where chenrgdB is the log value of a channel energy $ch_enrg_i$ in dB, ibin is a histogram bin index for the ith histogram of NCHAN histograms containing energy data for channel i, and dbstep is the energy quantization step size in dB. For one exemplary embodiment of the NNSE method, dbstep is equal to 1.0 which gives a 1 dB resolution over a 90 dB signal dynamic range. Thus, there are 90 energy bins per energy channel histogram, each with a unique index ibin corresponding to a quantized energy value. The index ibin is passed to the next process through block 706.

The fourth process in the NNSE method is to determine a probability distribution for the detected energy minima for each frequency channel. The steps to accomplish this are depicted in FIG. 8 in blocks 802 through 805 and described by the pseudo-code below. The channel energy probability distributions are derived by first histogramming the minimum energy values. A histogram is created for each of the NCHAN channels. A histogram of the frequency occurrence of minimum energies for each channel i is formed by incrementing the bin count $c_{ij}$ of the jth bin corresponding to the quantized detected minimum energy value index ibin. In order to track changing noise over time, the histogram bin sums are time-weighted using an exponentially decaying window function. The time constant of this window function, decayfi, determines time relevancy of the histogram data and thus the currency of the noise estimate. For one exemplary embodiment, the value of decayfi is set to 0.2; wherein decayfi is the histogramming exponential window function parameter. The histogram thus represents a time dependent snapshot of the distribution of noise energy in each channel. Pseudo-code for the histogram formulation is:

Histogram Formation Pseudo-code

```
    psum_i = 0.0
    for (0 <= j < nbins)          /* loop over all energy bins */
Block 802
    {
      if (j = ibin)               /* update the bin */
Block 803
        a = 1.0
    else
        a = 0.0
    c_ij = c_ij + (a − c_ij)*decayfi   /* apply exponential decay window
*/ Block 804
    psum_i = psum_i + c_ij        /* sum counts for a total count */
    }
```

$Psum_i$ is the sum of all the histogram values for the ith histogram and is used later as a normalization parameter to calculate probabilities. nbins is the maximum number of histogram energy bins; a is a bin increment constant; and $c_{ij}$ is the histogram value for the ith channel and the jth quantized energy bin. These steps are depicted in FIG. 8 blocks 802 through 804.

The probability distributions for each channel are calculated as shown in the pseudo-code below and the steps are depicted in FIG. 8 block 805. To calculate the probabilities the histogram values for each ith channel are normalized by the sum of the histogram bin counts, $psum_i$.

Probability Distribution Pseudo-code

```
    for (0 <= j < nbins)          /* loop over all energy bins */
      {
        p_ji = c_ij/psum_i        /* calculate histogram probabilities */
Block 805
      }
```

The probability distributions are output to the last NNSE method process as depicted in block 806.

The last process in the NNSE method is the calculation of the noise estimate. The steps to accomplish this are depicted in FIG. 9 blocks 901 through 907. Needed information input to this process is indicated in FIG. 9 by block 901. In actuality, three different values of the noise estimate are calculated expressing different characteristics of the noise. These are the expected value $nsev_i$ of the noise based on the detected energy minima; the noise energy value with the maximum probability $emaxprob_i$, based upon the probability distributions, and a weighted composite measure $enscomp_i$, that is a weighted combination of the $nsev_i$ and $emaxprob_i$ estimates. The pseudo-code for calculating these noise estimates is given below and corresponds to blocks 902 through 904.

The expected value of the noise for the ith channel, $nsev_i$, is calculated by summing the dot product of the ith channel's probability distribution and the corresponding quantized energy values. Depending on the value of decayfi the noise expected value tends to lag the true current noise estimate, if the noise is changing rapidly. The maximum probability estimate for the ith channel, $emaxprob_i$, tends to track quickly changing noise with much less lag, but also tends to slightly overestimate the noise and has a higher variance.

Noise Estimate Calculation Pseudo-code

```
  eprob = 0.0                     /* initialize noise energy probability */
  nsev = 0.0                      /* initialize expected value of the noise */
  steps = dbstep                  /* initialize histogram energy step counter */
  for (0 <= j < nbins)            /* loop over all energy bins */
Block 902
  {
    nsev_i = nsev_i + p_ij*(steps)  /* calculate noise energy expected value
*/ Block 903
    if (p_ij >= eprob)            /* search for noise energy with max
probability */
    {
      emaxprob_i = steps          /* cal max probability noise energy */
  Block 904
      eprob = p_ij
    }
    steps = steps + dbstep        /* increment energy step counter */
  }
```

Here $p_{ij}$ is the probability for jth histogram energy for the ith channel. $nsev_i$ is the expected value noise estimate, and $emaxprob_i$ is the maximum probability noise estimate. dbstep is the minimum quantized energy step in dB. For example, for a 90 bin histogram it corresponds to a value of 1 dB. steps is the value of the energy in dB corresponding to the jth histogram bin. Accordingly, the $5^{th}$ histogram bin would correspond to an energy value of 5 dB.

A composite measure, $enscomp_i$, can be formulated from $nsev_i$ and $emaxprob_i$ according to Equation 5 and shown in FIG. 9 block 905.

$$enscomp_i = \gamma \cdot nsev_i + (1-\gamma) \cdot emaxprob_i,\ i=1, \ldots, \text{NCHAN}. \quad \text{Eq. 5}$$

Block 905

γ is the weighting factor with values between 0.0 and 1.0 that is adjusted for the desired tracking response. Note that in general, $nsev_i$, the expected value noise estimate tends to lag the current true minimum frame energy (i.e. noise) because it is based on past energy minimum values over a finite past time interval. Its value is slower to reflect fast changes in the noise level but is closer to the true value of steady state or slowly changing noises. $emaxprob_i$ responds much more quickly to rapid changes in the level of the noise since the energy values that are most immediately detected (within the time window of the histogram update) near an energy minimum are most likely to occur more frequently and thus have the highest probability. Using the NNSE method $emaxprob_i$ tends to sometimes slightly over or under estimate the true noise but responds quickly to noise changes. $nsev_i$ more accurately represents the true noise but does not track fast changes in noise quickly. $enscomp_i$ is a compromise value that allows the NNSE method to choose a balance between estimation accuracy and tracking speed based on the value of the weighting parameter $\gamma$. This value can be chosen based on the nature of the noise and on the intended use of the noise estimate. For example, if the intended use of the noise estimator is to control an AVC function (FIG. 1 block 110), it is more important to track fast changes in the noise level. If the use is for noise suppression (FIG. 1 block 103), a more accurate noise estimate is more important.

Lastly, the expected value of the noise energy, the maximum noise energy probability, and the composite noise energy estimates are converted from the log energy domain back into the linear energy domain (block 906) as given in Equations 6, 7, and 8 below, and output to the external processes requiring them (block 907).

$$\text{ch_noise}H_i=10^{nsev_i/10},\ i=1,\ldots,\text{NCHAN}. \quad \text{Eq. 6}$$

Block 906

$$e\text{maxprob}_i=10^{emaxprob_i/10},\ i=1,\ldots,\text{NCHAN} \quad \text{Eq. 7}$$

$$ens\text{comp}_i=10^{enscomp_i/10},\ i=1,\ldots,\text{NCHAN} \quad \text{Eq. 8}$$

The noise estimates are output to an external device in FIG. 9 block 907 and the method suspends operations to wait for the next data frame as in block 910.

The plot of FIG. 10 shows the signal energy in dB along with the VAD noise update flag from the IS-127 noise estimator, and the energy peak detection flag (pk) generated by the NNSE noise estimator. The bottom plot shows the noisy speech test signal overlayed by the clean speech signal for comparison. Consequently, the plot demonstrates that the IS-127 estimator does not do a very good job of identifying and tracking the noise segments, in this instance babble noise.

The plot in FIG. 11 shows the tracks of the NNSE expected value and maximum probability noise estimates in addition to the basic IS-127 noise estimate. The occurrences of the minimum peak detection flag (pk) are also shown along with the IS-127 noise update flag. Clearly, the NNSE algorithm does a much better job of tracking the nonstationary babble noise.

Other exemplary embodiments of the process used by the NNSE method to search, identify, and track signal energy minima are possible. A second exemplary embodiment is now described.

In the second exemplary embodiment of the NNSE method, the process for identifying and tracking the signal energy minima includes a minimum peak follower that tracks increasingly lower energy values until a local minimum is found. The identified local minima are averaged over a defined time period to form a reference signal called eminmean which is used to determine if a present signal frame energy esum is likely to represent a noise energy frame. This second exemplary embodiment of the energy minimum search process of the NNSE method differs from the first exemplary embodiment, previously described above, primarily in the manner in which the search is conducted and in how the reference signals used for detection are determined.

The second exemplary embodiment of the NNSE search process is illustratively depicted in flowchart form in FIG. 12, blocks 1201 through 1212. In this embodiment of the search process several reference signals are determined that track certain aspects of the input signal energy. Specifically, a reference signal called eavg tracks the average energy of the input signal. A reference signal called emax tracks the maximum energy peaks of the input signal. A reference signal called emaxmin tracks the average of the minima of the emax reference signal. A reference signal called eminmean tracks the average of the identified local minima of the input signal. A reference variable called emin represents the value of the latest identified signal energy minimum. A binary flag signal called pk is used to indicate that a new local energy minimum has been detected.

All reference signals and variables are initialized to selected values upon reception of the first signal energy frame as depicted in FIG. 4 block 402, as is the case for the preferred embodiment search method. The first reference signal to be calculated is the average signal energy, esum. This calculation is depicted in FIG. 12, block 1201 and is defined by Equation 9:

$$e\text{avg}=\sigma\cdot e\text{avg}+(1-\sigma)\cdot e\text{sum}, \quad \text{Eq. 9.}$$

where eavg represents the average signal energy, esum is the current input signal frame energy, and $\sigma$ is a constant that controls the smoothing of the average over time. In the second embodiment of the NNSE method search process $\sigma$ may have a value of 0.9 which represents a time significance window of about 0.2 seconds. This value is selected empirically based on the average modulation rate of speech.

The second reference signal calculated in the search process is emax. emax is an intermediate reference signal used in the calculation of the reference signal emaxmin. The calculation of emax is shown in FIG. 12, blocks 1202, 1203, and 1204. emax represents the track of the maximum signal energy and thus represents the upper limit of the search for a local energy minimum, emin. If the current frame energy esum is greater than the current value of emax then emax is updated to the current frame energy value as in block 1203. If not then emax is allowed to adjust according to Equation 10, represented in process block 1204.

$$e\text{max}=\eta\cdot e\text{max}+(1-\eta)\cdot|e\text{max}-e\text{avg}|, \quad \text{Eq. 10.}$$

where emax is the current maximum signal energy reference, eavg is the average signal energy, and $\eta$ is a constant that partially controls the exponential adjustment of emax over time. Note that the rate of adjustment of emax is determined by the absolute value of the difference between emax and eavg. This means that emax adjusts faster when the peak-to-average signal energy is large (i.e. when speech is likely present) and at a slower rate when it is small. The value of $\eta$ is determined empirically and in the second embodiment of the search process of the NNSE method is set to 0.8.

Of importance in detecting local input signal energy minima are the minima of the emax signal. These emax minima are used to calculate another reference signal called emaxmin. emaxmin is a signal that follows the energy of the input signal but which is closer to the values of input signal energy minima since it represents the areas of the signal where the energy is above but near the minimum values of the signal energy. These are the signal periods that occur between speech energy peaks and where local energy minima are most likely to be found. emaxmin is calculated in a manner similar to the calculation of emax and is depicted in FIG. 12, blocks 1205, 1206, and 1207. If the current frame maximum energy emax is less than or equal to the current value of emaxmin then emaxmin is updated to the current value of emax as in block 1206. If not then emaxmin is allowed to adjust according to Equation 11, represented in process block 1207.

$$e\text{maxmin}=\kappa\cdot e\text{maxmin}+(1-\kappa)\cdot|e\text{maxmin}-e\text{max}|, \quad \text{Eq. 11.}$$

where emaxmin is the current minimum of the reference signal emax reference, and κ is a constant that partially controls the exponential adjustment of emaxmin over time. Note that the rate of adjustment of emaxmin is determined by the absolute value of the difference between emaxmin and emax. This means that emaxmin adjusts faster when the difference is large and at a slower rate when it is small. The value of κ is determined empirically and in the second embodiment of the search process of the NNSE method is set to 0.99 corresponding to a time window of approximately 2 seconds, the average duration of a spoken word or phrase. Pseudo-code for the calculation of the emax and emaxmin reference signals depicted in FIG. 12, blocks 1202 through 1207 is shown below.

emax and emaxmin Reference Signal Calculation Pseudo-code

```
if (esum >= emax)                    /* track energy maximums */
Block 1202
  emax = esum
Block 1203
else
  emax = emax − (1.0 − η)*abs(emax − eavg)
Block 1204
if (emax <= emaxmin AND emax > 0.0)   /* track emax minimums */
Block 1205
  emaxmin = emax
Block 1206
else
  emaxmin = emaxmin + (1.0 − κ)*abs(emaxmin − emax)
Block 1207
```

The next step in the second embodiment of the search process of the NNSE method is the calculation of the emin reference signal for detecting input signal local energy minima. emin is a reference signal that tracks the energy minima of the input signal. emin is calculated in a manner similar to the calculation of emax and emaxmin and is depicted in FIG. 12, blocks 1208, 1209, and 1210. If the current frame energy esum is less than or equal to the current value of emin as in block 1208 then emin is updated to the current value of esum as in block 1209 and a minimum peak detection flag, pk, is set equal to 1. It is in this step that a local energy minimum is detected. If the current frame energy esum is greater than the current energy minimum the peak detection flag pk is set to zero and the energy minimum is allowed to slowly increase towards the reference signal emaxmin until a new local minimum reference is detected. The local energy minimum reference is allowed to slowly increase to account for the condition that the local noise energy may be increasing. Thus the energy minimum cannot "get stuck" on a global energy minimum value but instead can track changing energy minima over a chosen time scale. emin is allowed to adjust according to Equation 12 represented in process block 1210, and the minimum pk detection flag is reset to 0.

$$emin=\rho\cdot emin+(1-\rho)\cdot|emaxmin-emin|, \qquad \text{Eq. 12.}$$

where emin is the current energy minimum reference signal, and ρ is a constant that partially controls the exponential adjustment of emin over time. Note that the rate of adjustment of emin is determined by the absolute value of the difference between emaxmin and emin. This means that emin adjusts faster when the difference is large, that is when the signal energy represented by the reference emaxmin is significantly higher than the current minimum energy reference emin.

Thus, if there is a sudden increase in the noise level emin adjusts to follow it. The value of ρ is determined empirically and in the second embodiment of the search process it is set to 0.99. Smaller values can be used to increase the base adaptation rate.

The last step in the second embodiment of the minimum energy search process is to update the eminmean minimum energy reference signal. eminmean is a time weighted average of the detected energy minima and sets the threshold reference by which a local energy minimum is detected. It is calculated according to Equation 13 and depicted in FIG. 12, block 1211.

$$eminmean=\alpha\cdot eminmean+(1-\alpha)\cdot emin, \qquad \text{Eq. 13.}$$

Where α is a constant that partially controls the exponential adjustment of eminmean over time. The value of α is determined empirically, and in the second embodiment of the search process it is set to 0.8. It is the same calculation as depicted in FIG. 6, block 610 in the description of the preferred embodiment of the minimum energy search process of the NNSE method.

The signal frames in which local energy minima are detected indicate where input signal energy minima are most likely to represent noise (i.e. speech signal not present). If the current frame energy is less than or equal to the average minimum energy reference eminmean, then the current signal frame is determined to be a likely noise frame and thus the frame channel energies should be included in the noise estimate update. In this case the process proceeds to the noise update process as depicted in FIG. 7 block 701 and discussed previously with regard to the preferred embodiment search process of the NNSE method. If the current signal frame energy esum is greater than the minimum energy reference signal eminmean, then the current frame energy is likely not to be noise. In this case a search for the next local energy minimum is continued and process waits for the arrival of the next input frame as depicted in FIG. 4 block 401. This test for a likely noise frame is depicted in FIG. 12 block 1212.

Pseudo-code for the calculation of the emin and eminmean reference signals as depicted in FIG. 12, blocks 1208 through 1212 is shown below. Note that abs refers to the absolute value function.

emin Minimum Energy Reference Signal Calculation Pseudo-code

```
    if (esum <= emin && esum > 0.0)      /* detect energy
minima */
    Block 1208
      { emin = esum
    Block 1209
      pk = 1                /* set min pk flag to 1 */
    }
    else
    {
      emin = emin + (1.0 − ρ)*abs(emaxmin − emin) /* adj
energy min ref */
    Block 1210
      pk = 0                /* set min pk flag to 1 */
    }
  eminmean = α *eminmean + (1.0 − α)*emin            /* calc
min mean */
Block 1211
  if (esum C ≤ eminmean)    /* test if current frame is a likely
noise frame */
Block 1212
  {
    GO TO noise update step in block 701
  }
  else
    {
    GO TO block 401 to wait for next input data frame
  }
```

eminmean is the running average of the detected energy minima. The multiplicative constant C is a factor empirically derived that represents a measure of the noise variance and in the second embodiment of the search process has a value of 2.0.

A representative plot of the parameters and reference signals used in the second embodiment of the energy minima search process of the NNSE method is shown in FIG. 13.

A number of inventions and published methods have been proposed to estimate background noise in an audio signal for various purposes. Some methods specifically seek to improve noise estimation accuracy in nonstationary or speech-like noise. Of particular relevance here are methods based on so-called minimum energy statistics. The assumed basis of these methods is that speech, being intermittent in nature, contains many short pauses between syllables, words, and sentences in which only background noise is present. In the speech pauses the signal energy falls to a relative minimum and represents only the background noise. By searching for these minimum signal energy periods and measuring the localized signal energy information, a more accurate and timely noise estimate may be obtained, even when speech is present.

It is the general object of the present invention called the Nonstationary Noise Estimator method, herein referred to as the NNSE method or simply NNSE, to provide an estimate for noise in a signal that may contain information, and for use by other signal processors that may require such information. It is a further object of the present invention to detect and track abrupt or fast changes in the noise, whether or not the signal may also contain a speech signal. Another object of the present invention is to track and estimate the noise as often as possible by seeking and identifying periods of minimum signal energy during which an informational component of the signal is not present. A further object of the present invention is to improve the accuracy of the noise estimate by minimizing minimum energy identification errors using a probabilistic estimate of the noise based on the occurrence frequency of the various minimum signal energy measurements. It is a further object of the present invention to utilize information about the signal from other noise estimators such as, for example, the noise estimator described in TIA/EIA/IS-127, "Enhanced Variable Rate Codec, Speech Service Option 3 for Wideband Spread Spectrum Digital Systems", July 1996, to supplement the method of the current invention in detecting periods of minimum signal energy. It is another object of the present invention to improve the overall system noise estimation performance when used in conjunction with other noise estimators such as for example, the noise estimator described in TIA/EIA/IS-127, "Enhanced Variable Rate Codec, Speech Service Option 3 for Wideband Spread Spectrum Digital Systems", July 1996.

In accordance with these and other objects of the present invention, the present invention does not rely on a VAD device to identify signal data frames containing only noise. It improves the immediacy of the noise estimate by continuously identifying and tracking frame energy minima that are likely to be noise. Tracking follows changes in noise energy and tracks noise even during short speech pauses, and can follow rapid or sudden changes in the noise level. The NNSE method calculates the expected value of the noise energy and the maximum probability of the noise energy using an adaptive probabilistic histogram method which reduces the effects of noise energy tracking errors. Combining the NNSE noise estimate with that produced by a more conservative noise estimator such as the one described in TIA/EIA/IS-127, "Enhanced Variable Rate Codec, Speech Service Option 3 for Wideband Spread Spectrum Digital Systems", July 1996, expands the range of noise types for which an accurate noise estimate can be obtained and improves the performance of the IS-127 noise suppressor and other types of noise estimate-dependent signal processors in nonstationary types of noise.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein; therefore, the NNSE method or estimator may be implemented in a microprocessor, for example. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, one or more of the NNSE embodiments can be implemented as a non-transitory machine readable storage device, having stored thereon a computer program including several code sections that comprise the NNSE method. Likewise, the NNSE method may be implemented in or on a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

I claim:

1. A method implemented by a noise estimation processor for estimating acoustic noise in an environment where a mobile communication device is operating and where the acoustic noise includes nonstationary noise or speech-like noises, and wherein the environment also includes speech signals, comprising:

calculating, with the noise estimation processor, a composite frame energy signal from a current segment of an input signal, wherein the input signal comprises a frequency channel energy vector for a voice signal;

searching, with the noise estimation processor, for a local minimum energy over a plurality of frames using at least two reference signals including a first signal comprised of a time-sensitive current local minimum energy estimate, emin, and a second signal comprised of a time-weighted average of previous detected local energy minima, eminmean;

deciding, with the noise estimation processor, whether the detected local energy minima of the second reference signal is a noise signal;

quantizing separately, with the noise estimation processor, an energy of each sub-band of the input signal;

determining, with the noise estimation processor, a particular bin within a plurality of histogram bins that correspond to a quantized noise energy value for each sub-band such that detected input signal energy minima values are binned within the plurality of histograms;

calculating, with the noise estimation processor, a composite noise energy estimate comprised of a weighted sum of a maximum probability noise energy estimate and an expected value noise energy estimate; and sending, by the noise estimation processor, the composite noise energy estimate to one or more of a noise suppressor configured to suppress noise based on the composite noise energy estimate, and a spectral shaper configured to enhance frequencies based on the noise energy estimate.

2. The method claimed in claim 1, wherein searching, with the noise estimation processor, for the local minimum energy further comprises the step of:

calculating, with the noise estimation processor, a difference signal, ediff, as a difference between the value of a last identified signal energy local minimum that is time-sensitive and the second signal comprised of a time-weighted average of previous detected local energy minima.

3. The method claimed in claim 2, wherein the esum is not a new local minimum, a peak found flag, pk is set to zero and a "no peak found" counter, minpkcnt is incremented.

4. The method claimed in claim 2, wherein searching, with the noise estimation processor, for the local minimum energy further comprises deciding, with the noise estimation processor, whether a current frame energy, esum, is a new local minimum energy.

5. The method claimed in claim 4, wherein the esum is a new local minimum energy, the method updates the emin to equal esum.

6. The method claimed in claim 4, further comprising using, with the noise estimation processor, a plurality of parameters and a reference signal that comprises variance of the eminmean signal, eminmeanVar, to detect the behavior of the input signal energy, wherein the parameters include ediff and minpkcnt.

7. The method claimed in claim 6, wherein the parameter minpkcnt is compared to PKDWELL, wherein PKDWELL is a maximum allowed dwell time in which no local energy minima has been detected.

8. The method claimed in claim 6, wherein the input energy signal is rising rapidly or decreasing slowly, or where no local energy minimum has been detected for a maximum allowed dwell time; and wherein ediff is less than zero, then emin is set equal to current frame energy, esum.

9. The method claimed in claim 6, wherein the input energy signal is rising rapidly or decreasing slowly, or where no local energy minimum has been detected for a maximum allowed dwell time; wherein ediff is greater than zero, then emin is updated using an exponential smoothing function.

10. The method claimed in claim 6, wherein the input energy signal is not rising rapidly or not decreasing slowly, or where local energy minimum has been detected within a maximum allowed dwell time; wherein ediff is less than zero emin is updated using an exponential smoothing function.

11. The method claimed in claim 6, wherein ediff is greater than zero, emin is updated using an exponential smoothing function.

12. The method claimed in claim 1, wherein searching, with the noise estimation processor, for the local minimum energy further comprises:

generating, with the noise estimation processor, a first reference signal, emax, that tracks maximum peak energies of the input signal over a sequence of time frames;

generating, with the noise estimation processor, a second reference signal, emaxmin, that tracks minimum of the first reference signal, emax; such that the range of the search is set by emaxmin;

generating, with the noise estimation processor, a third reference signal, emin, that serves a reference in detecting local energy minima.

13. The method claimed in claim 1, wherein calculating, with the noise estimation processor, the composite noise energy estimate further comprises:

summing, with the noise estimation processor, a fractional multiple of the maximum probability noise energy estimate and a fractional multiple of the expected value noise energy estimate such that the sum of the fractional multipliers equal a value of one.

14. The method claimed in claim 1, wherein the current segment of an input signal is represented as a vector of sub-band energies representing a frame of the input signal.

15. The method claimed in claim 1, wherein the current segment of an input signal is represented as a full or partial sum of the sub-band energies representing a frame of the input signal.

16. The method claimed in claim 1, wherein the current segment of an input signal is represented as a total energy calculated in a time domain representing a frame of the input signal.

17. The method claimed in claim 1, further comprising supplementing, with the noise estimation processor, a noise estimator, for the mobile communication device, that is described by TIA-EIA-IS-127 industry standard.

18. The method claimed in claim 17, wherein the supplemented noise estimator is combined with the nonstationary noise estimator (NNSE) when the NNSE determines a high probability of noise as a part of the input signal and when the supplemented noise estimator has erroneously not detected noise during a same instance of the input signal.

19. A non-transitory machine readable storage device, having stored thereon a computer program including a plurality of code sections comprising:

code for calculating a composite frame energy signal from a current segment of an input signal;

code for searching for a local minimum energy over a plurality of frames using at least two reference signals including a first signal comprised of a time-sensitive current local minimum energy estimate, emin, and a second signal comprised of a time-weighted average of previous detected local energy minima, eminmean;

code for deciding whether the detected local energy minima of the second reference signal is a noise signal;

code for separately quantizing an energy of each sub-band of the input signal;

code for determining a particular bin within a plurality of histogram bins that correspond to a quantized noise energy value for each sub-band such that detected input signal energy minima values are binned within the plurality of histograms; and code for calculating a composite noise energy estimate comprised of a weighted sum of a maximum probability noise energy estimate and an expected value noise energy estimate.

20. The non-transitory machine readable storage device of claim 19, wherein the code for searching for the local minimum energy further comprises:

code for calculating, with the noise estimation processor, a difference signal, ediff, as a difference between the value of a last identified signal energy local minimum that is time-sensitive and the second signal comprised of a time-weighted average of previous detected local energy minima.

21. The non-transitory machine readable storage device of claim 19, wherein the code for searching for the local minimum energy further comprises:

code for generating, with the noise estimation processor, a first reference signal, emax, that tracks maximum peak energies of the input signal over a sequence of time frames;

code for generating, with the noise estimation processor, a second reference signal, emaxmin, that tracks minimum of the first reference signal, emax; such that the range of the search is set by emaxmin;

code for generating, with the noise estimation processor, a third reference signal, emin, that serves a reference in detecting local energy minima.

22. A communication device comprising:

a microphone; and a noise estimation processor coupled to the microphone, the noise estimation processor adapted to:

receive an input signal, the input signal comprising a frequency channel energy vector for a voice signal, calculate, a composite frame energy signal from a current segment of the input signal, search for a local minimum energy over a plurality of frames using at least two reference signals including a first signal comprised of a time-sensitive current local minimum energy estimate, emin, and a second signal comprised of a time-weighted average of previous detected local energy minima, eminmean, decide whether the detected local energy minima of the second reference signal is a noise signal, quantize separately an energy of each sub-band of the input signal;

determine a particular bin within a plurality of histogram bins that correspond to a quantized noise energy value for each sub-band such that detected input signal energy minima values are binned within the plurality of histograms, calculate a composite noise energy estimate comprised of a weighted sum of a maximum probability noise energy estimate and an expected value noise energy estimate, and send the composite noise energy estimate to one or more of a noise suppressor and a spectral shaper.

23. The communication device of claim 22, further comprising a transmitter coupled to the noise suppressor, the noise suppressor adapted to receive the composite noise energy estimate and the input signal, to suppress noise based on the composite noise energy estimate, and to produce a noise suppressed signal.

24. The communication device of claim 22, further comprising a speaker, the speaker coupled to the spectral shaper, the spectral shaper adapted to receive the composite noise energy estimate and enhance frequencies of the based on the composite noise energy estimate, the signal envelope shaper to produce an enhanced signal.

* * * * *